United States Patent [19]

Ladick et al.

[11] Patent Number: 4,858,934

[45] Date of Patent: Aug. 22, 1989

[54] GOLF PRACTICE APPARATUS

[75] Inventors: Robert B. Ladick, New Westminster; Bryan E. Ladick, West Vancouver, both of Canada

[73] Assignee: Syntronix Systems Limited, Burnaby, Canada

[21] Appl. No.: 186,915

[22] Filed: Apr. 27, 1988

[51] Int. Cl.[4] ..... A63B 69/36

[52] U.S. Cl. ..... 273/186 A; 273/183 A; 273/185 B; 273/186 R

[58] Field of Search ..... 273/26 R, 26 B, 29 H, 273/181 H, 35 R, 183 A, 183 D, 183 E, 185 B, 186 R, 186 A, 73 R, 77 R, 163 R, 164

[56] References Cited

U.S. PATENT DOCUMENTS

| | | | |
|---|---|---|---|
| 2,080,608 | 5/1937 | Hannaford | 273/183 D |
| 4,254,956 | 3/1981 | Rusnak | 273/181 H |
| 4,306,722 | 12/1981 | Rusnak | 273/183 E |
| 4,437,672 | 3/1984 | Armantrout et al. | 273/181 H |
| 4,693,479 | 9/1987 | McGwire | 273/186 A |

*Primary Examiner*—Leo P. Picard

*Attorney, Agent, or Firm*—Fetherstonhaugh & Co.

[57] ABSTRACT

Apparatus for the practicing of golf swings has a club member to be swung by a user in simulation of the swinging of a golf club, the club member having a simulated golf club handgrip and a source of radiation for providing a beam extending from one end of the club member in the longitudinal direction of the club member, the beam having a flat leading side. Sensors responsive to the radiation for sensing the swinging of said club member are disposed in a predetermined array in the vicinity of a simulated golf ball impact location for providing sensor signals in response to the passage of the beam over the array. The sensor signals are processed for providing first signals corresponding to the direction of travel of the beam, second signals corresponding to the speed of travel of the beam and third signals corresponding to the orientation of the beam. The first, second and third signals are employed for computing a golf ball flight and providing corresponding output signals to a monitor for providing a visual representation of the flight of the golf ball.

23 Claims, 7 Drawing Sheets

GOLF PRACTICE APPARATUS

FIELD OF THE INVENTION

The present invention relates to apparatus for the practising of golf swings and, more particularly, to apparatus which provides the user with a visual display of the result of a golf swing by the user.

BACKGROUND OF THE INVENTION

As will be readily appreciated by golfers, much of the difficulty in playing golf in a successful manner is involved in ensuring that the orientation of the golf club head is exactly correct at the instant of impact of the club head against the ball.

Consequently, many golfers spend much time practising their golf swings with different types of golf club. However, such practising cannot be performed, for example, in a room of a normal household, because most houses and apartments have ceilings which are only eight feet high and a full swing with a wood or iron golf club would therefore produce holes and other damage to the ceilings of such rooms. Furthermore, a wide-open space is required in order to avoid damage to the contents of the room, and it has been estimated that an area of at least fifteen feet by twelve feet of open space would be required to enable a golfer to swing a driver comfortably. A still further danger is the risk of damage to the surface of the floor, because of the absolute necessity of contact of the golf club with the floor. In this connection, golfers will appreciate that, on a golf course, it is necessary to remove a small divot during a swing in order to achieve correct flight of the ball. Even if the contents of a room could be displaced to provide sufficient space for a full swing, and if a protective covering could be placed on the floor, it is nevertheless not feasible, without great expense and difficulty, to raise the ceilings of most rooms to avoid damage.

Previous attempts have been made to provide apparatus for facilitating the practising of golf swings.

For example, United States Patent 4,137,566, issued Jan. 13, 1987 to Steven L. Haas et al, disclosed an apparatus and method for analysing a golf swing and displaying the results in which light sources are attached to appropriate locations on the golfer himself or on a golf club, the light from these light sources being detected by electro-optical sensors having different fields of view encompassing the golfer and the golf club during at least a portion of the golf swing. The outputs of the sensors are electronically processed to provide alpha-numeric or graphic data for display. However, as will be immediately apparent from the above remarks, the disadvantage of this prior apparatus and method is that they require the user to swing a golf club, which as explained above is impractical in many rooms.

Another prior art golf swing practising apparatus is shown in United States Patent 4,254,956, issued Mar. 10, 1981 to Thomas L. Rusnak, which discloses apparatus for photoelectrically sensing the time and position of a golf club head at selected stations along a practise swing. Corresponding characteristics of the swing and the resulting ball flight are computed electrically and displayed to the player. However, once again, this prior apparatus has the disadvantage that it requires the use of a real golf club or, at least, a simulated golf club having the same dimensions as a real golf club.

In United States Patent 4,542,906, issued Sept. 24, 1985 to Akio Takase et al, there is disclosed a computer-aided golf training device which detects movement of a golf ball immediately after the ball has been impacted by a club head. Consequently, this prior apparatus again requires the use of a golf club and, further, has the disadvantage that it requires a ball to be struck and thereby put into flight, which would increase even further the space required.

BRIEF SUMMARY OF THE INVENTION

It is, accordingly, an object of the present invention to provide a novel and improved apparatus for the practising of golf swings which avoids the use of a golf club.

To that end, the present invention provides an elongate member, which is swung by a user in simulation of the swinging of a golf club and which projects a beam of radiation from one end thereof, the beam being detected by sensors to provide signals which are electronically processed to provide a visual display corresponding to the swing.

In particular, according to the invention there is provided apparatus for the practising of golf swings, comprising an elongate member to be swung by a user in simulation of the swinging of a golf club, the elongate member comprising a simulated golf club hand grip, a source of radiation and means for forming the radiation into a beam exending from one end of the elongate member in the longitudinal direction of the elongate member. A plurality of sensor means are disposed in a predetermined array for providing sensor signals in response to the passage of the beam over the array during the swinging of the elongate member. Means are provided for processing the sensor signals to produce output signals corresponding to the motion of the elongate member, and visual display means responsive to the output signals provide a visual representation corresponding to the output signals.

The visual representation may, for example, take the form of a picture illustrating the flight of a golf ball, the flight varying in dependence on various characteristics of the swinging of the elongate member.

By thus employing detection of the beam during the swing, instead of detecting motion of a golf club head, the elongate member may have a length substantially less than that of a golf club, thus avoiding the space requirements for the swinging of a golf club.

In a preferred embodiment of the invention, the array of sensor means is supported on the floor, beneath the path of travel of the elongate member during the swinging of the elongate member, and in the vicinity of a simulated golf ball impact location. The sensor means comprise groups of sensors which are differently arranged for sensing the direction of movement of the beam through the impact location, the timing of the beam during the passage of the beam over the array and the inclination of the beam as the beam passes through the impact location.

BRIEF DESCRIPTION OF THE DRAWINGS

The invention will be more readily understood from the following description of a preferred embodiment thereof given, by way of example, with reference to the accompanying drawings, in which.

THE PREFERRED EMBODIMENT

Figure 1:
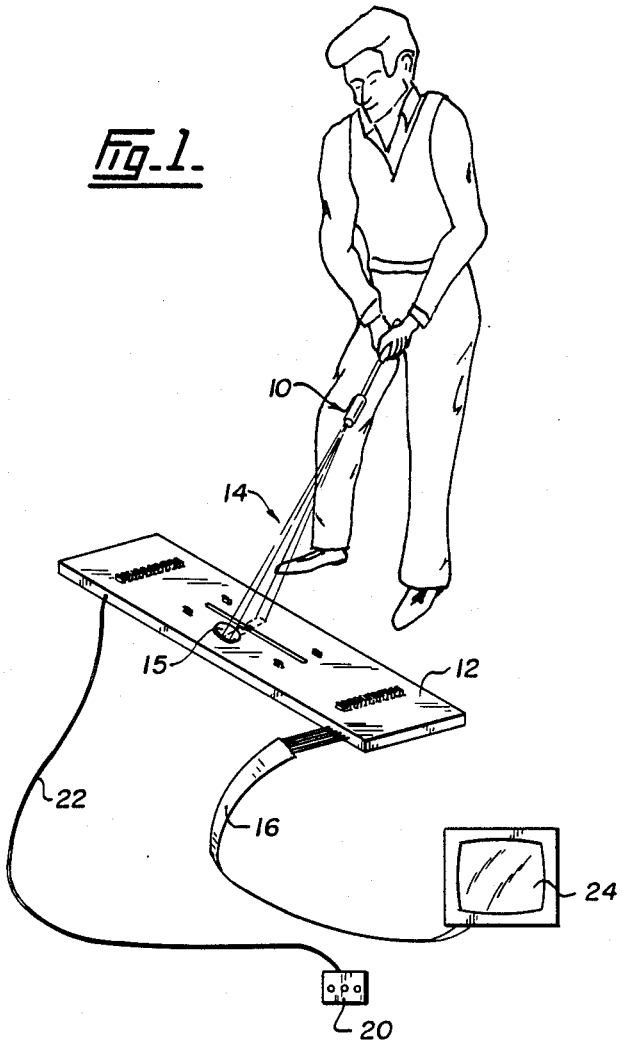
FIG. 1 shows a view in perspective of a golf swing practise apparatus embodying the present invention while in use by a golfer.

Referring now to FIG. 1 of the accompanying drawings, the golf swing practise apparatus illustrated therein comprises a simulated golf club in the form of an elongate club member indicated generally by reference numeral 10, which has a length approximately one-half of the length of a conventional golf club and which, as illustrated in FIG. 1, is swung by the user of the apparatus in simulation of the swinging of a golf club.

The apparatus further includes a shallow, elongate housing 12 of rectangular shape, which is placed on the floor while the apparatus is in use and which, as described in greater detail below, incorporates an array of light detectors for detecting a light beam, indicated generally by reference numeral 14, which extends from one end of the club member 10 in the longitudinal direction of the club member 10, the arrangement being such that the light beam 14 sweeps along at least a portion of the upper surface of the shallow rectangular housing 12 during the simulated golf swing.

The shallow rectangular housing 12 is connected by a cable 16 to a monitor 24 for providing the user of the apparatus with a visual display of the results of his simulated golf swings. A control switch unit 20 is connected by means of a cable 22 to the housing 12 for providing user input into the apparatus, as described in greater detail below.

Figure 2:
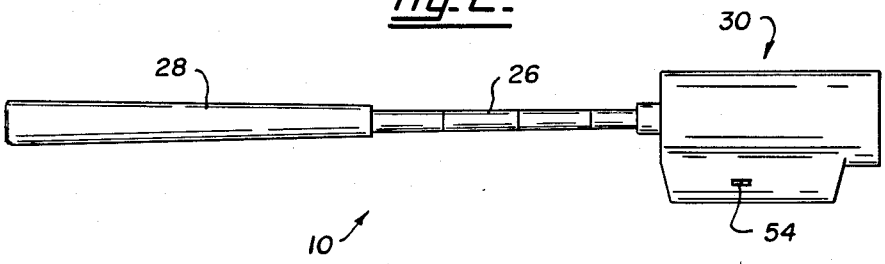
FIG. 2 shows a view in side elevation of a club forming part of the apparatus of FIG. 1.
Figure 2A:
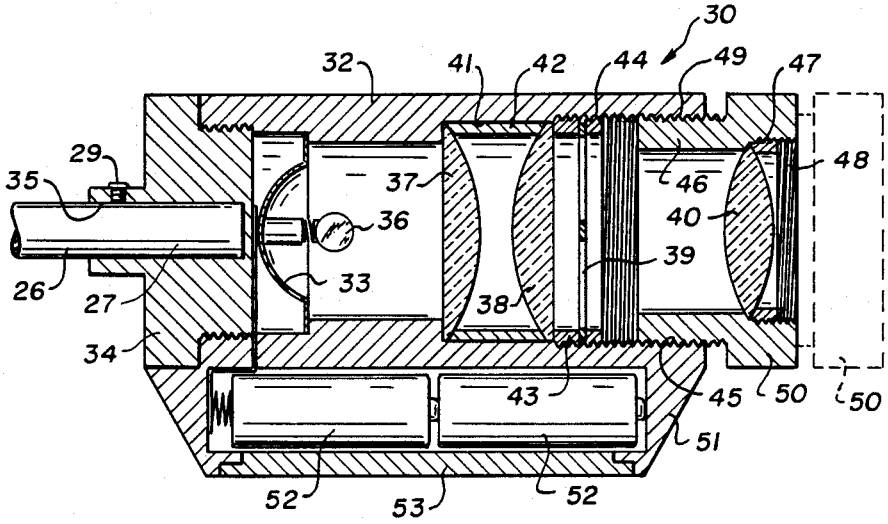
FIG. 2A shows a more detailed view, partially broken away in longitudinal cross-section, of the club of FIG. 2.

Referring now to FIGS. 2 and 2A, it will be seen that the club member 10 comprises a tubular metal shaft 26 provided at one end thereof with a simulated golf club hand grip 28 and, at the other end thereof, with a club head indicated generally by reference numeral 30.

The club head 30 comprises an elongate housing 32 formed at one end thereof with an end closure 34, which is in threaded engagement with the corresponding end of the housing 32 and formed with a cylindrical opening 35 for receiving an end 27 of the shaft 26, the end 27 being adjustably secured by a grub screw 29 in threaded engagement with the end closure 34.

The housing 32 contains a light source in the form of a light bulb 36 provided with a reflector 33. A pair of condensing lenses 37 and 38 are provided for redirecting the light from the light bulb 36 through a mask or diaphragm 39, which is desribed in greater detail below with reference to FIG. 3, and a focussing lens 40 to form the beam 14.

The lenses 37 and 38 are held apart in a cylindrical bore 41 in the housing 32 by a cylindrical spacer 42, and threaded retainer rings 43 and 44 are screwed into an internal thread 45 in the housing 32 to retain the diaphragm 39, the lenses 37 and 38 and the spacer 42 in position in the housing 32.

The focussing lens 40 is secured in a sleeve 46 by a retainer ring 47 in threaded engagement with an internal thread 48 in the sleeve 46. An external thread 49 on the sleeve 46 is in threaded engagement with the internal thread 45 of the housing 32. The sleeve 46 has at one end a cylindrical peripheral projection 50, the periphery of which is knurled to facilitate manual rotation of the sleeve 46 relative to the housing 32 for axially displacing the focussing lens 40 and thereby focussing the beam 14.

The housing 32 is formed with an integral auxiliary housing 51, which serves to contain a pair of batteries 52 for energizing the light bulb 36. The batteries 52 are retained in the auxiliary housing 51 by means of a closure 53 in snap-in engagement with the auxiliary housing 51. Manually actuatable switch 54 (FIG. 2) serves, when closed, for completing a circuit through the light bulb 36 and the batteries 50 illuminating the light bulb 36 to produce the light beam 14.

Figure 3:
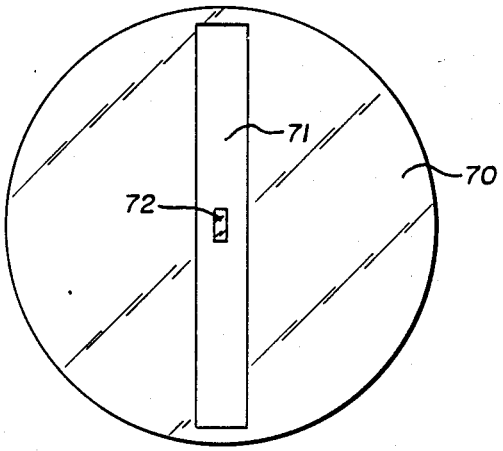
FIG. 3 shows a view in elevation of a diaphram forming part of the optical system of the club of FIG. 2.

The diaphragm 39 comprises a disc of transparent material, e.g. glass, provided with an opaque coating. As shown in FIG. 3, this coating comprises an outer portion 70, and is formed with a central rectangular opening 71, within which there is a substantially smaller, rectangular opaque portion 72. Consequently, as will be readily apparent, the light which is transmitted by the condensing lenses 37 and 38 through the diaphragm 39 is formed so that the light beam 14 is of rectangular cross-section and, at its middle, has a dark spot or portion 74 (FIG. 4), i.e. a light-free portion, which is of rectangular shape and which corresponds to the opaque portion 72 of the diaphragm, this dark portion of the beam cross-section being surrounded by an illuminated area or portion 75 of rectangular shape.

The planar or flat leading side of the light beam 14, which forms the leading edge 76 of the rectangular illuminated area 75, and the dark spot or portion 74 are sensed by an array of light sensors in the housing 12 in order to determine the direction, speed and orientation of the light beam 14 as the club member 10 is swung to move the light beam 14 through an imaginary golf ball impact location on the housing 12, as described in greater detail below.

Figure 4:
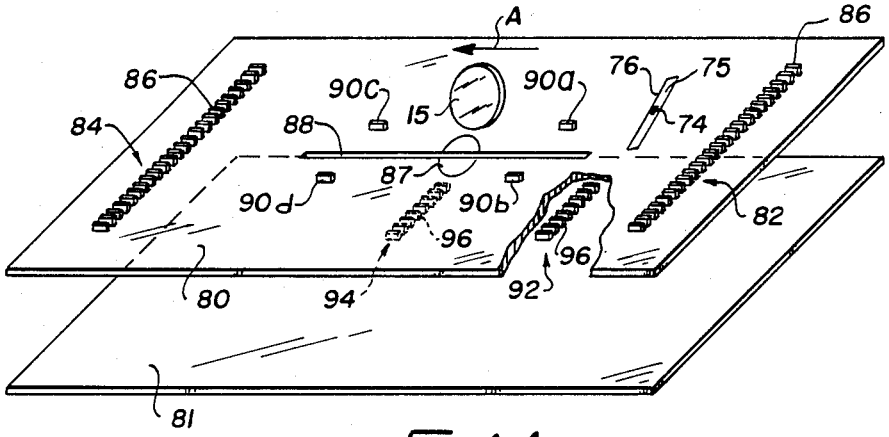
FIG. 4 diagramatically illustrates an array of light sensors included in the apparatus of FIG. 1.

This array of light sensors, which comprise phototransistors, is illustrated in FIG. 4 of the drawings, which shows two flat, horizontal, vertically spaced support boards 80 and 81, which are mounted in the housing 12.

On the upper support board 64 there is shown the above-described area 75 of light which is projected on to the upper board 80 by the light beam 14. The array of light sensors comprises, firstly, two parallel rows or end banks, indicated generally by reference numerals 82 and 84, of light sensors 86, the rows 82 and 84 being spaced apart in the longitudinal direction of the board 80, which is indicated by arrow A, with the rows 82 and 84 extending transversely of the direction A.

In the present embodiment of the invention, each of the rows or end banks 82 and 84 comprises twenty-four sensors 86. However, the number of sensors is not critical and may be varied depending upon the particular type of sensor employed and the dimensions of the sensor array as a whole.

As the light beam 14 sweeps across the end banks 82 and 84 in succession, the rectangular illuminated area 75 and the rectangular dark spot 74 cause some of the light sensors of each end bank 82 and 84 to be successively energized, de-energized, energized again and, finally, again de-energized. It is the first of these de-energizations, corresponding to the passage of the dark spot 74 over the light sensors, which is detected to indicate the passage of the axis of the light beam 14 over the rows 82 and 84. Also, the individual light sensors 86 of each row or end bank 82 and 84 are constantly monitored in succession, and the light sensors, in each row, which respond to the dark spot 74 are used to indicate the presence of the dark spot 74. These light sensors thus provide an indication of the direction of the path of movement of the light beam 14 across the board 80 and, thus, through the location of impact of the light beam with an imaginary golf ball. The location of this imaginary golf ball is indicated by a disk 87 painted on the top of the housing 12 in a colour, e.g. white, which contrasts with the colour, e.g. green, of the remainder of the housing 12 to indicate to the user where he should aim his swing.

The board 80 is formed, at a central portion thereof, with a longitudinal slot 88, which allows a portion of the light beam 14 to pass downwardly through the board 80, and an array of four light sensors **90*a*, 90*b*, 90*c* and 90*d* are spaced apart at opposite sides of and longitudinally of the slot 88**.

Two parallel sensor rows, indicated generally by reference numerals 92 and 94, each comprising eight light sensors 96, are mounted on the lower board 81, and are spaced apart longitudinally along the board 81 beneath the slot 88, the rows 92 and 94 extending transversely of the longitudinal direction A. More particularly, these two rows 92 and 94 are positioned to intercept the above-mentioned portion of the light beam 14 which passes downwardly through the slot 88.

The light sensors **90*a*–90*d* are employed to detect the timing of the travel of the planar front or leading side of the light beam 14 during the passage of the light beam 14 through the imaginary golf ball impact location represented by the disk 87**.

In addition, the light sensors 96 are employed to sense the angle of the light beam during the passage of the light beam through the imaginary golf ball impact location, i.e. The inclination of the longitudinal axis of the club 10.

More particularly, considering for a moment only the four sensors **90*a*–90*d*, as the leading edge 76 of the illuminated area 75 sweeps in succession over these sensors, they will be energized at successive time intervals which vary in dependence, firstly, on the direction of travel of the light beam 14 relative to the housing 12 and, secondly, on the orientation of the illuminated area on the board 80**.

Consequently, these four light sensor **90*a*–90*d* are insufficient to distinguish variations of those time intervals resulting from differences in the direction of travel of the light beam from those variations resulting from differences in the orientation of the illuminated area 75**.

However, these differences can be distinguished from one another by also taking with account the timing and location of the beam portion which passes downwardly through the slot.

This beam portion is so narrow as to iluminate only one sensor in row 92 and one sensor in row 94.

Which of the sensors 96 of each row is illuminated depends on the direction of the longitudinal axis of the beam 14 and, thus, that of the club 10, assuming that those two axes are co-incident.

Consequently, by detecting the timings of the energization not only of the four sensors **90*a*–90*d* but also those of the two illuminated sensors 96, and by also taking into account the direction of travel of the beam, as detected by the end bank sensors, the spatial orientation, i.e. The three-dimensional orientation, of the plane of the leading side of the light beam 14** can be determined by the processing of the sensor signals, and also the speed of travel of the light beam can be measured.

Figure 4A:
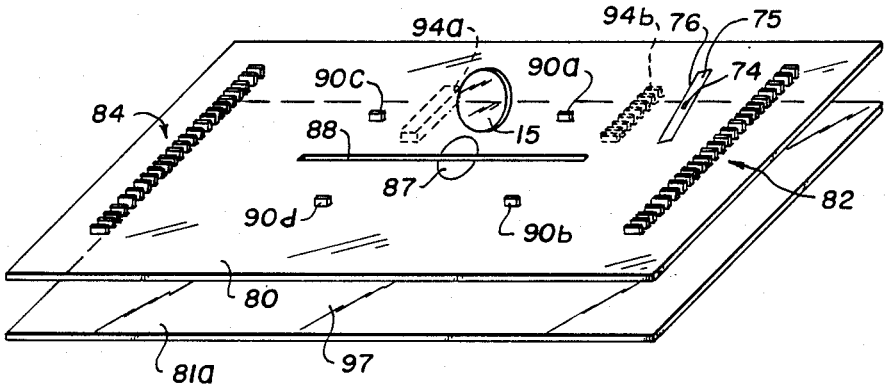
FIG. 4A shows a modification of FIG. 4.

In FIG. 4A, parts which correspond to those shown in FIG. 4 have, for convenience, been indicated by the same reference numerals.

However, the sensor array of FIG. 4A differs from that of FIG. 4 in that, instead of having the sensor rows 92 and 94 mounted on the board 81 at a spacing below the board 80, in this case a corresponding pair of sensors rows, indicated by reference numerals **92*a* and 94*a*, are mounted in a downwardly facing fashion on the underside of the board 80 and the board 81 of FIG. 4 is replaced by a board 81*a* which is closer to the board 80. The board 81*a* is provided with a mirrored upper surface 97 for reflecting upwardly onto the sensor array comprising the sensor rows 92*a* and 94*a* the portion of the light beam 14 which passes downwardly through the slot 88**.

Figure 5:
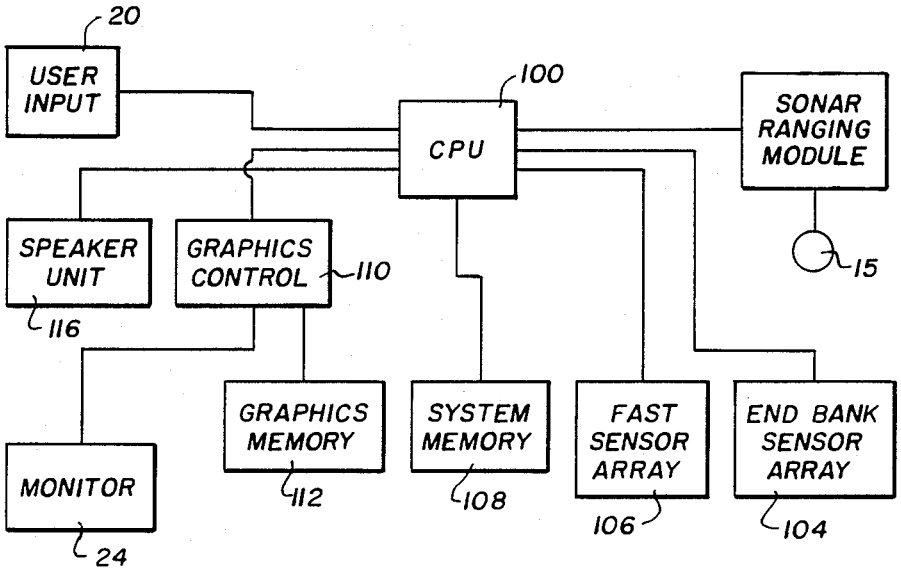
FIG. 5 shows a block diagram of the electronic components of the apparatus of FIG. 1.

Referring now to the block diagram of the apparatus shown in FIG. 5 of the drawings, a central processing unit CPU 100 is connected to the control switch unit 20, which comprises three manually operable switches for providing user input into the CPU 100.

The CPU is also provided with input data from an end bank sensor array 104, which incorporates the two rows or end banks 82 and 84 of light sensors 86, and a fast sensor array 106, which incorporates the light sensors **90*a*–90*d* and 96**.

A system memory 108 is connected to the CPU 100 and serves to store program data for controlling the operation of the apparatus.

The CPU 100 outputs a signal to a graphics control circuit 110 which, in response to data from the CPU 100 and to data stored in a graphics memory 112, provides a display on the screen of the monitor 24.

More particularly, the switch unit 20 may be employed by the user, at the beginning of a game, to provide appropriate input into the CPU 100 for selecting, for example, which of the eighteen holes of a golf course he wishes to play. Graphics data relating to this hole is then transferred from the system memory 108 to the graphics memory 112. Also, the switch unit 102 may, for example, be employed for presetting parameters such as wind speed, the speed of the green on which a game is to be played, etc.

When the user then swings the club 10 so as to cause the light beam 14 to sweep across the sensor array in the housing 12, the direction and orientation of the light beam 14, and thus of the club member 10, as the light beam passes through the simulated golf ball impact location, are sensed as described above and corresponding data is fed from the end bank sensor array 104 and the fast sensor array 106 to the CPU 100.

Figure 6:
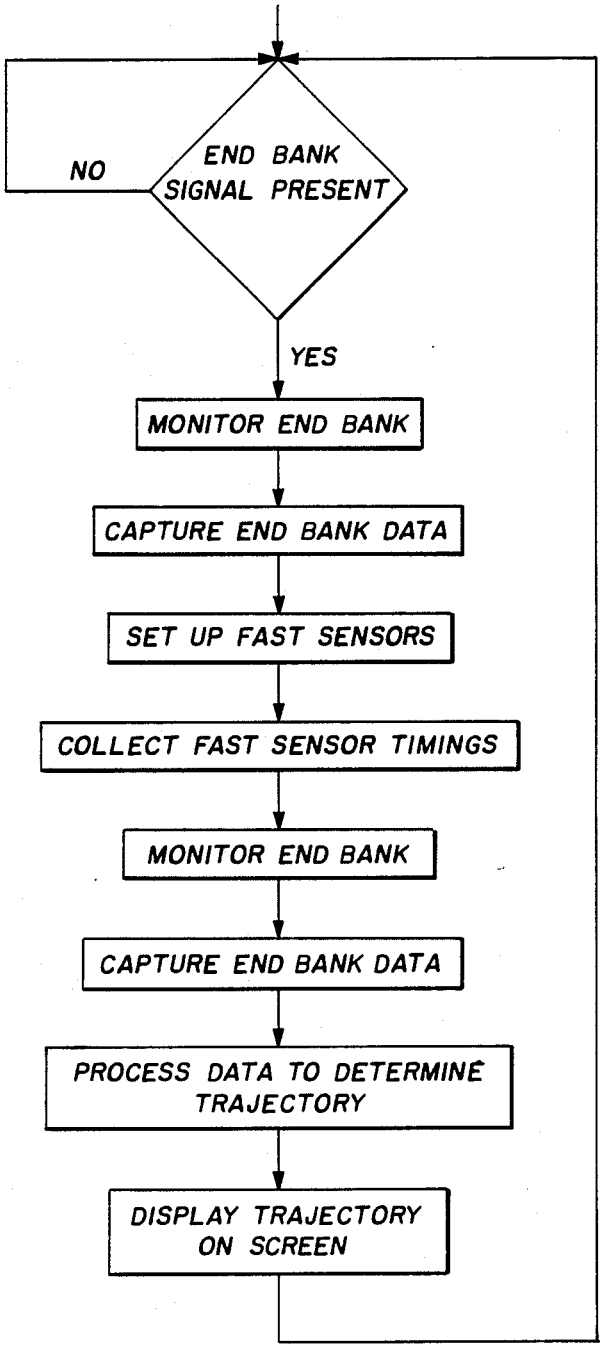
FIG. 6 shows a flow chart illustrating the operation of the components shown in FIG. 5.

More particularly, at the beginning of the sensing of a golf swing, the sensors 86 of rows 82 and 84, represented as the end bank sensor array 104 in FIG. 5, is checked for the presence of a signal from any of the end bank sensors 86, as indicated in the flow chart of FIG. 6. In response to detection of such a signal, the end bank sensors 86 are monitored to determine which of them first detects the dark spot 74, as described above, and the fast sensors, i.e. The fast sensor array 106 comprising the fast sensors 90*a*–90*d* and 96, are set up so that the timings of the energization of those sensors can be detected. Under control of the data stored in the system memory 108, the CPU 100 then computes the trajectory or flight of an imaginary golf ball and outputs corresponding flight data to the graphics control 110.

The graphic control 110 combines the flight data with data relating to the golf course obtained from the graphics memory 112 to provide on the screen of the monitor 24 a graphical representation of a hole of the golf course with, superimposed thereon, the trajectory or flight of the imaginary golf ball. Thus, the user can observe on the screen of the monitor 24 a graphical display of the results of his swing.

The CPU 100 also provides an output to a speaker unit 116, for providing an audio signal. More particularly, the speaker unit 116 is operated by the CPU 100 to provide an audio signal corresponding to the sound of a golf club striking golf ball as the light beam 14 passes through the imaginary golf ball impact location. Also, the speaker unit 116 is controlled so as to provide appropriate sound signals when, for example, the imaginary flight of the golf ball lands in water.

Figure 7:
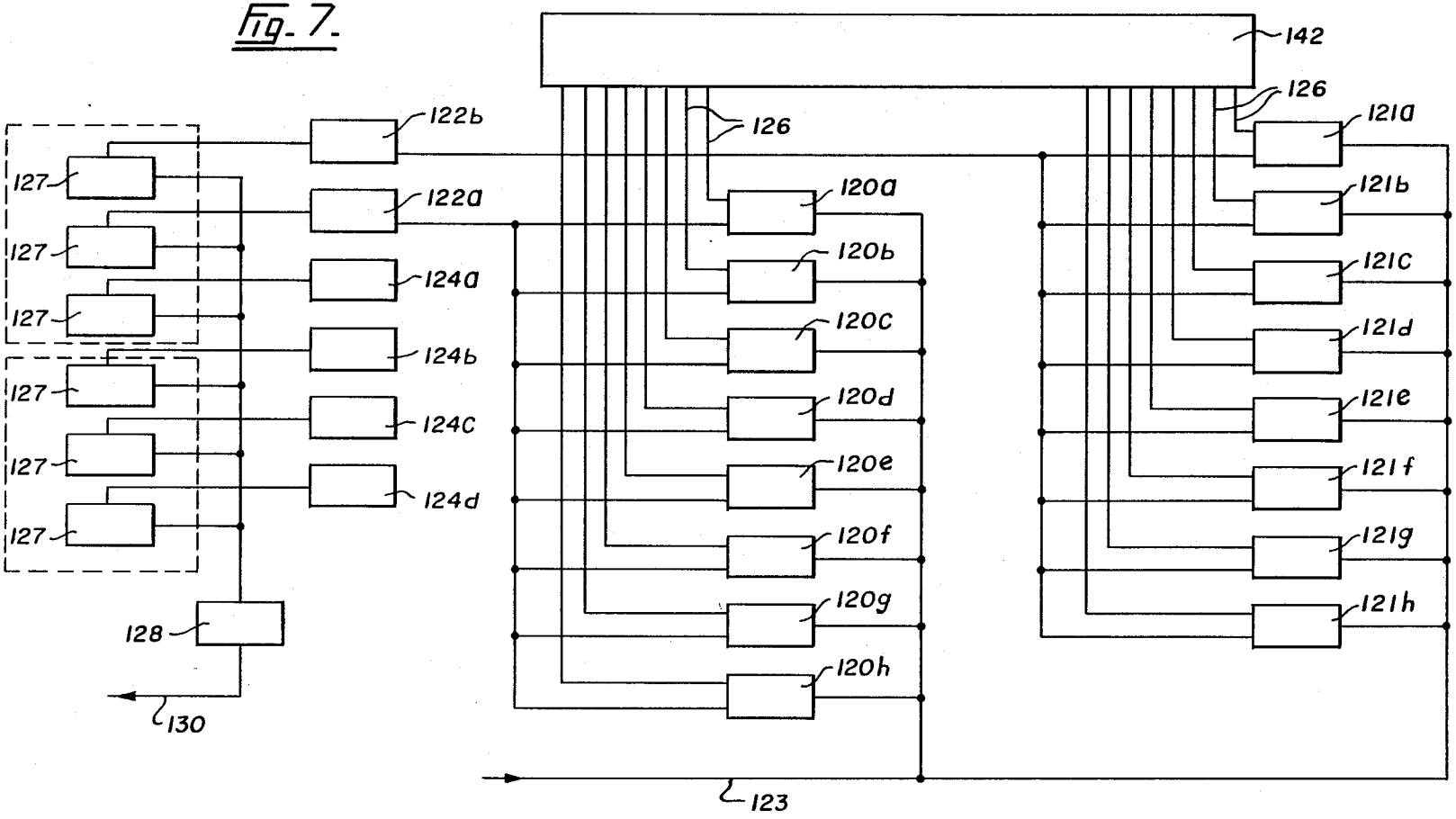
FIG. 7 shows a more detailed block diagram of the fast sensor array of FIG. 5.

Referring now to FIG. 7, which illustrates in block diagram form the fast sensor array 106 comprising the sensors 90*a*–90*d* and the rows of sensors 92 and 94 shown in FIG. 4, there are shown sensor circuits 120*a*–120*h* and 121*a*–121*h*.

The sensor circuits 120*a*–120*h* each comprise one of the sensors 96 of the sensor row 92 (or 92*a*) with associated circuitry, and the sensors 121*a*–121*h* each comprise one of the sensors 96 of the sensor row 94 (or 94*a*) with associated circuitry, as will be described in greater detail below.

The sensor circuits 120*a*–120*h* and 121*a*–121*h* are corrected to a common input conductor 123, to which a DAC voltage is applied.

FIG. 7 also shows two circuits 122*a* and 122*b* connected to the outputs of the sensor circuits 120*a* and 121*a*, respectively, for processing the output of these circuits, and four sensor circuits 124*a*–124*d*, which each comprise a respective one of the sensors 90*a*–90*d* and associated components, as described in greater detail below with reference to FIG. 9A.

The sensor circuits 120*a*–120*h* each have an output connected to the circuit 122*a* and the sensor circuits 121*a*–121*h* each have an output connected to the circuit 122*b*.

In addition, the sensor circuits 120*a*–120*h* and 121*a*–121*h* also each have an output connected by a conductor 126 to the CPU 100.

The outputs of circuits 122*a*, 122*b* and 124*a*–124*d* are connected to respective latches 127 of an 8-bit counter 128, the output which is connected by conductor 130 to a 16-bit counter in the CPU 100.

Figure 8:
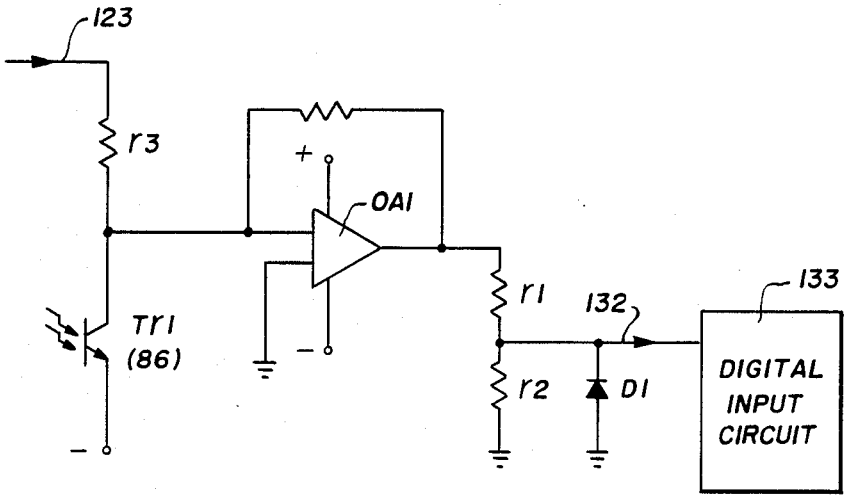
FIG. 8 shows a circuit diagram of an end bank light sensor circuit included in the end bank sensor array of FIG. 5, and associated components.
Figure 10:
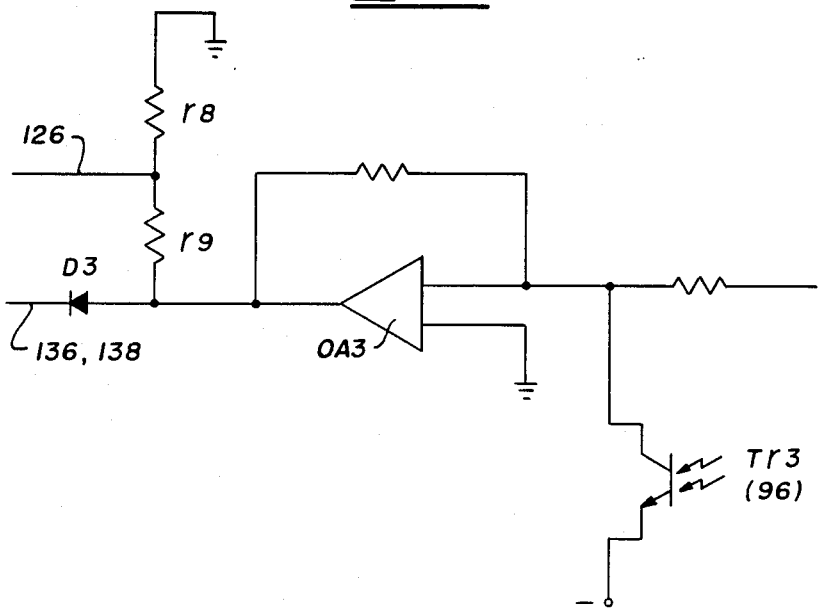
FIGS. 9 and 10 show circuit diagrams of two of the light sensors incorporated in the fast sensor array of FIG. 5, together with associated components.
Figure 9:
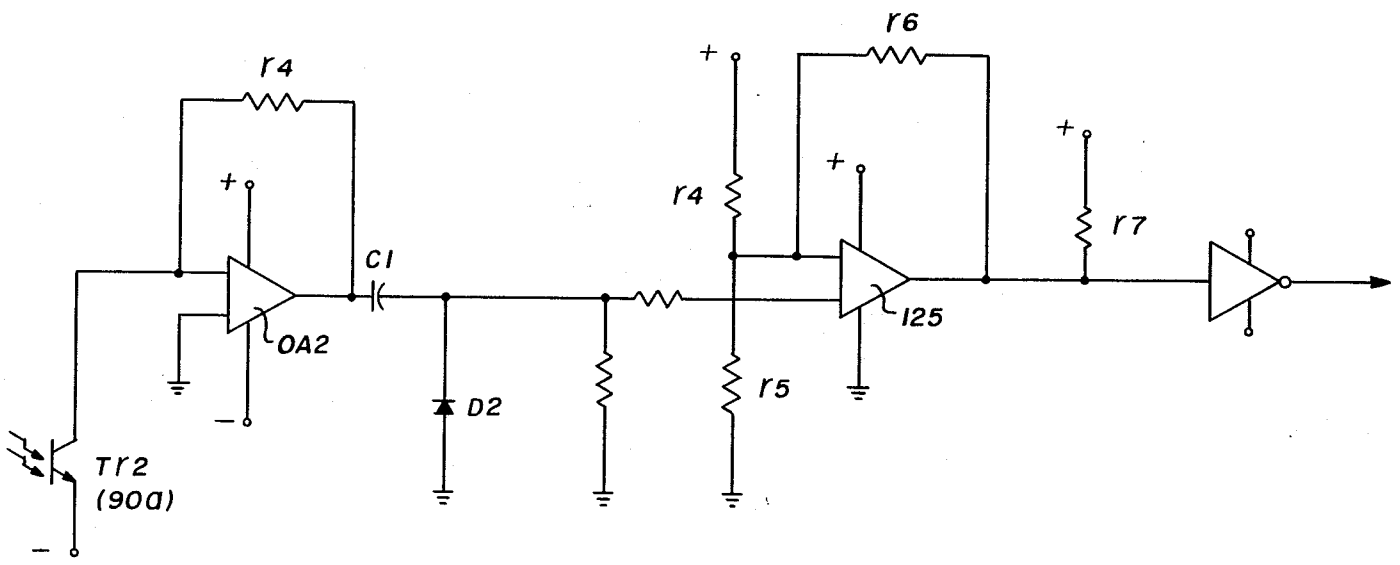

The sensor circuits will not be descended in greater detail with reference to FIGS. 8, 9 and 10.

FIG. 8 shows a sensor circuit incorporating one of the end bank sensors 86, each of which has a similar circuit. The sensor 86 shown in FIG. 8 is implemented as an infra-red phototransistor Tr1 which, when energized, provides a voltage at the output of an operational amplifier 0A1. A voltage divider comprising resistors r1 and r2 is used to reduce this voltage, the reduced voltage being applied by conductor 132 to a digital input circuit 133, implemented as an 8255 chip, which is one of a pair of such circuits respectively connected to the end banks 82 and 84.

The DAC voltage from conductor 123 and a resistor r3 are employed to compensate the phototransistor Tr1 when there is ambient infra-red radiation, by providing a current to null the output of the operational amplifier 0A1.

A diode D1 is provided to protect the input of the digital input circuit 133. This is required since, when the circuit is compensating for infra-red and if the ambient infra-red then disappears, the output of the operational amplifier 0A1 would be driven negative and, therefore, so would the input of the digital input circuit if the diode D1 were not present.

The digital input circuit is polled by the CPU100 to determine the status of the end bank sensors 86.

FIG. 9 shows one of the sensor circuits 124*a*–124*d* of the sensors 90*a*–90*d*, the remainder of which are similar to that shown in FIG. 9. In this case, the negative light sensor, e.g. sensor 90*a*, comprises a phototransistor Tr2, which produces a A.C. pulse at the output of an operational amplifier 0A2, which is coupled through a capacitor C1 to the rest of the circuit. The capacitor C1 and a resistor r4 form a high pass filter, and a diode D2 clamps negative voltage. A comparator 125 compares this pulse with a reference voltage provided by a voltage divider formed by resistor r4 and r5, and a resistor r6 provides hysteresis for the comparator circuit. Since the comparator output is open collector, resistor r7 is provided to raise the output voltage of the circuit.

The circuits 122*a* and 122*b* (FIG. 7) are similar to the circuits 124*a*–124*b* except that the phototransistor Tr2 and the operational amplifier 0A2 are omitted and the circuits 122*a* and 122*b* have capacitors, corresponding to the capacitor C1, which couple the outputs of sensor circuits 120*a*–120*h* and 121*a*–121*h*, respectively, supplied by conductors 136 and 138, to the circuits 122*a* and 122*b*.

FIG. 10 shows one of the sensor circuits 120*a*–120*h* and 121*a*–121*h*, the remainder of which are similar. The respective sensor 96 is implemented as a phototransistor Tr3, which controls an operational amplifier 0A3, the output voltage of which is applied through a diode D3 to the conductor 136, in the case of one of the circuits 120*a*–120*h*, or 138, in the case of one of the circuits 121*a*–121*h*. The output voltage of the operational amplifier 0A3 is reduced by a voltage divider comprising resistors r8 and r9 and applied to the respective conductor 126, which is connected to a respective port of one of a pair of digital input circuits 140, 142, (FIG. 7) which are implemented as 8255 chips and serve as inputs to the CPU 100.

When the phototransistor Tr3 is energized, it provides a signal through the respective conductor 126 to the respective part of the digital input circuit 140 or 142 by which the CPU 100 determines which of the phototransistors Tr3, i.e. which of the light sensors 96, has been illuminated by the portion of the light beam passing through the slot 88. As described above, this data is employed in the computation of the orientation of the longitudinal axis of the club 10.

Also, the same phototransistor Tr3, through its conductor 136 or 138 and its associated circuit 122*a* or 122*b*, and through the corresponding latch 127, latches the timer 128.

Likewise, when one of the four sensors 90*a*–90*d* is energized, its sensor circuit 124*a*–124*d*, through the corresponding latch 127, latches the timer 128.

The timer 128 is an 8-bit counter, and is connected to a 16-bit counter in the CPU 100.

With this arrangement, the timings of the illuminations of the sensors 96 and 90*a*–90*d* are latched in hardware and can be retrieved during the interrupt service routine of the CPU 100 to enable the timings for these sensors to be measured accurately, and a 24 bit time resolution is employed, at 0.5 microseconds, to provide an interval of 8 seconds. This accuracy directly determines the accuracy of the measurements as a function of velocity of the light beam.

We claim:

1. Apparatus for the practising of golf swings, comprising:

an elongate member to be swung by a user in simulation of the swinging of a golf club;

said elongate member comprising a simulated golf club handgrip, a source of radiation and means for forming radiation from said radiation source into a beam extending from one end of said elongate member in the longitudinal direction of said elongate member;

a plurality of sensor means responsive to said radiation and disposed in a predetermined array for producing sensor signals in response to the passage of said beam over said array during the swinging of said elongate member;

means for processing said sensor signals to produce output signals corresponding to the speed and orientation of said elongate member; and visual display means responsive to said output signals for providing a visual representation corresponding to said output signals.

2. Apparatus as claimed in claim 1, including means for supporting said array of sensor means in the vicinity of as imaginary golf ball impact location disposed beneath the path of travel of said elongate member during the swinging of said elongate member.

3. Apparatus as claimed in claim 2, wherein said supporting means comprise means for supporting said sensor means array on a floor.

4. Apparatus as claimed in claim 1, wherein said means for forming said beam comprise means for imparting a planar shape to a leading side of said beam, said processing means including means responsive to passage of said beam leading side over said predetermined array for detecting the three-dimensioned orientation of said beam leading side relative to said predetermined array.

5. Apparatus as claimed in claim 4, wherein said means for forming said beam further comprise means for forming a radiation-free zone within said beam, said processing means including means responsive to passage of said radiation-free zone over said predetermined array for detecting the direction of travel of said beam over said predetermined array.

6. Apparatus as claimed in claim 1, wherein said plurality of sensor means comprise first sensor means for sensing the direction of movement of said beam through a simulated golf ball impact location, second sensor means for sensing the timing of said light beam during the passage of said beam over said predetermined array and third sensor means for sensing the inclination of said beam as said beam passes through said simulated golf ball impact location.

7. Apparatus as claimed in claim 1, wherein said plurality of sensor means comprise first and second rows of sensors arranged with said first row parallel to and laterally spaced from said second row for sensing the direction of movement of said beam through a simulated golf ball impact location.

8. Apparatus as claimed in claim 1, wherein said predetermined array of sensor means comprises first and second rows of sensors arranged with said first row parallel to and laterally spaced from said second row, means providing an opaque covering over said first and second rows for shielding said first and second rows from said beam, and means defining in said opaque covering a slot extending transversely of said first and second rows for allowing radiation from said beam to reach portions of said first and second rows, depending upon the inclination of said beam.

9. Apparatus as claimed in claim 8, wherein said plurality of sensor means comprise first and second rows of sensors arranged with said first row parallel to and laterally spaced from said second row for sensing the direction of movement of said beam through a simulated golf ball impact location.

10. Apparatus as claimed in claim 1, wherein said plurality of sensor means comprise a group of sensors mutually spaced in an array for sensing the timing of said beam.

11. Apparatus as claimed in claim 1, wherein said visual display means comprise memory means for storing data relating to a graphical display of portions of a golf course, and means responsive to said graphical display data and said output signals for displaying a graphical representation of said golf course portions and of a golf ball flight corresponding to said output signals, with said flight superimposed on said golf course portions.

12. Apparatus as claimed in claim 11, wherein said processing means includes means responsive to the motion of said elongate member and to the graphical display data for outputting sound control signals, said apparatus including means for generating sound in response to said sound control signals.

13. Apparatus as claimed in claim 1, wherein said processing means includes means responsive to the motion of said elongate member for outputting sound control signals, said apparatus including means for generating sound in response to said sound control signals.

14. Apparatus as claimed in claim 1, wherein said sensor means comprise a plurality of sensors distributed in a three-dimensional array, said processing means comprising means responsive to said sensor signals for determining the three-dimensional orientation of said beam during the passage of said beam over said array.

15. Apparatus as claimed in claim 14, wherein said sensors comprise a plurality of said sensors arranged at a first level for detecting the speed and direction of said beam, and a plurality of said sensors arranged at a second level lower than said first level, and further comprising mask means between said first and second levels and defining a slot through which a portion of said beams can reach said sensors on said second level to enable the orientation of said beam to be determined by orientation determining means.

16. Apparatus for the practising of golf swings, comprising:

a club member to be swung by a user in simulation of the swinging of a golf club;

said club member having a simulated golf club handgrip, a source of radiation, means for forming said radiation into a beam extending from one end of said club member in the longitudinal direction of said club member and with said beam having a flat leading side;

sensor means responsive to said radiation for sensing the swinging of said club member;

said sensor means being disposed in a predetermined array in the vicinity of a simulated golf ball impact location for providing sensor signals in response to the passage of said beam over said array;

means responsive to said sensor signals for providing first signals corresponding to the direction of travel of said beam through said location, second signals corresponding to the speed of travel of said beam through said location and third signals corresponding to the three-dimensional orientation of said beam leading side during passage thereof through said location;

means responsive to said first, second and third signals for computing a golf ball flight and providing output signals corresponding to said flight; and visual display means responsive to said output signals for providing a visual representation of said flight.

17. Apparatus as claimed in claim 16, wherein said visual display means comprise means for displaying a graphical representation of said flight.

18. Apparatus as claimed in claim 17, further comprising means for storing data representing a graphical display of portions of a golf course, said visual display means comprising means for graphical displaying said flight representation superimposed on said golf course portions.

19. Apparatus as claimed in claims 16, wherein said sensor means comprise two sets of sensors arranged with said sets spaced apart along the direction of the path of travel of said beam through said location and with the sensors of each set distributed across said path for sensing said direction, said sensor signal responsive means including means responsive to said two sets of sensors for providing said first signals.

20. Apparatus as claimed in claim 16, wherein said sensor means comprise individual sensors spaced apart in the vicinity of said location for sensing the speed of travel of said beam, said sensor signal responsive means including means responsive to said sensors for providing said second signal.

21. Apparatus as claimed in claim 16, wherein said sensor means comprise a mask which is opaque to said radiation, first and second sets of sensors located above and below, respectively, said opaque mask and means defining an elongate opening in said mask through which radiation from the beam can reach said sensors below said mask, said sensor signal responsive means comprising means responsive to said first and second sets of sensors for providing said third signals.

22. Apparatus as claimed in claim 16, wherein said sensor means comprise a mask which is opaque to said radiation; first and second sets of sensors located above and below, respectively, said opaque mask, means defining an elongate opening in said mask through which a portion of said beam can pass downwardly through said mask and means below said mask for reflecting said beam portion upwardly to said second set of sensors, said sensor signal responsive means comprising means responsive to said first and second sets of sensors for providing said third signals.

23. Apparatus as claimed in claim 16, wherein said sensor means comprise first and second sets of sensors arranged with said first set spaced from said second set in the direction of the path of travel of said beam through said location and with the sensors of each of said sets distributed across said path for sensing said direction;

said sensor signal responsive means including means responsive to said first and second sets of sensors for providing said first signals;

said sensor means further comprising a mask opaque to said radiation, third and fourth sets of sensors disposed, respectively, above and below said mask and means defining an elongate opening in said mask through which a portion of said beam can reach said fourth set of sensors, depending on the orientation of said beam;

said fourth set being arranged in two mutually spaced, parallel rows extending tranversely of said direction; and said sensor signal responsive means including means responsive to said third set of sensors for providing said second signals and means responsive to said third and fourth sets of sensors for providing said third signals.

* * * * *